US008113159B2

(12) United States Patent
Myers et al.

(10) Patent No.: US 8,113,159 B2
(45) Date of Patent: Feb. 14, 2012

(54) CAMSHAFT PHASER AND DRIVE ADAPTER FOR A CONCENTRIC CAMSHAFT

(75) Inventors: Jesse Myers, Waterford, MI (US); Joseph Moon, Clawson, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 355 days.

(21) Appl. No.: 12/572,356

(22) Filed: Oct. 2, 2009

(65) Prior Publication Data

US 2010/0089352 A1 Apr. 15, 2010

Related U.S. Application Data

(60) Provisional application No. 61/105,181, filed on Oct. 14, 2008.

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 7,284,517 B2 10/2007 Lancefield et al.
8,051,818 B2 * 11/2011 Myers et al. ..... 123/90.17

FOREIGN PATENT DOCUMENTS

DE 102005014680 8/2006
DE 102006024794 12/2007

* cited by examiner

*Primary Examiner* — Ching Chang
(74) *Attorney, Agent, or Firm* — Volpe and Koenig, P.C.

(57) ABSTRACT

A camshaft adjuster for a concentric camshaft assembly of an internal combustion engine is provided. The adjuster includes a stator that is connected to the timing gear, and a rotor located within the stator having a plurality of vanes that extend into spaces created between inwardly directed projections of the stator to define chambers on each side of the vanes. Front and rear sidewalls are connected to the stator and form the front and rear walls of the chambers. An outer cover connects to the stator to the inner camshaft via a drive adapter, and the rotor is connected to the outer camshaft. Radial loads acting on the timing gear are transmitted from the stator to the rotor and into the outer camshaft. The drive adapter includes an open cylindrical body having first and second ends. The first end includes a slot or recesses in which a timing feature of the cover engages. The second end has a keyed portion configured to matingly engage a corresponding portion of the inner camshaft.

4 Claims, 4 Drawing Sheets

CAMSHAFT PHASER AND DRIVE ADAPTER FOR A CONCENTRIC CAMSHAFT

CROSS-REFERENCE TO RELATED APPLICATIONS

This application claims the benefit of U.S. Provisional Application No. 61/105,181, filed Oct. 14, 2008, which is incorporated herein by reference as if fully set forth.

FIELD OF INVENTION

The present invention relates to a camshaft adjuster or phaser for adjusting and fixing the phase position of a camshaft relative to the crankshaft of an internal combustion engine.

BACKGROUND

Camshafts are used in internal combustion engines in order to actuate the gas exchange valves. The camshaft in an internal combustion engine includes a plurality of cams that engage cam followers (i.e. bucket tappets, finger levers or rocker arms). When the camshaft rotates, the cams lift the cam followers which in turn actuate gas exchange valves (intake, exhaust). The position and the shape of the cams define the opening period and amplitude as well as the opening and closing time of the gas exchange valves.

Concentric camshaft assemblies are also known in which separate intake and exhaust camshafts are concentrically arranged by providing a hollow outer camshaft in which an inner camshaft is located, with the inner camshaft cam lobes being rotatable on the outer camshaft, and connected through slots in the hollow outer camshaft to the inner camshaft. This allows the use of separate camshafts for intake and exhaust valve actuation within generally the same space required for a single camshaft.

A camshaft adjuster generally comprises a timing gear, which can be a chain wheel, a belt wheel or a gear wheel, and it is connected in fixed rotation to the crankshaft by a chain, a belt or a gear drive, and acts as an input to the adjuster. The adjuster also includes an output connection to the camshaft. An adjusting input is also provided which can be a hydraulic, pneumatic or even electric drive to adjust the output rotation relative to the input. Commonly used arrangements include adjusters that operate on the vane-cell principle.

A single cam phaser (SCP) is shown in U.S. Pat. No. 7,284,517. This SCP allows the timing of an inner camshaft and/or an outer camshaft to be adjusted relative to an engine crankshaft. This phaser uses a separate nose support piece that is separately supported in the first camshaft bearing in order to carry the axial load from the timing chain into the outer camshaft. This requires the nose support piece to have tight tolerances, so that the radial load imparted by the timing chain or belt into the timing gear or pulley on the phaser is transmitted from the phaser into the more structurally rigid outer shaft. If such a load is supported mainly by the inner camshaft, such as shown in the arrangements of DE 10 2005 014 680 A1 or DE 10 2006 024 794 A1, bending of the inner shaft may occur, thereby causing the inner and outer camshafts to bind, preventing intake versus exhaust valve timing adjustment. Additionally, the rear plate of U.S. Pat. No. 7,284,517 has to be assembled separately to the outer camshaft prior to the front plate then being assembled and connected to the inner camshaft. This further complicates engine assembly.

In one known hydraulically activated camshaft phaser which operates on the vane-cell principle, the front and rear covers of the phaser are separately attached to the inner and outer camshafts. The drawback of this arrangement is that durability is somewhat limited, and attaching the vanes to the covers is cumbersome. Due to having the vanes of the phaser connected to front and rear covers of the phaser, seals are required to retain the pressurized hydraulic fluid required to move the vanes of the phaser. Such seals are subject to wear and eventual failure. Further, such a multipart arrangement greatly increases labor and time in assembling this known SCP phaser as the engine is assembled. In assembling such a phaser to a concentric camshaft, the risk of internal phaser contamination is high. Furthermore the installation time and complexity are increased since multiple portions must be separately attached to multiple parts of the camshaft. This also requires more complex disassembly and assembly in the field for service.

SUMMARY

The present invention relates to a camshaft adjuster for a concentric camshaft of an internal combustion engine. The adjuster includes a stator that is connected to a timing gear, and a rotor located within the stator and connected to the outer camshaft. The rotor includes a plurality of vanes that extend into spaces created between inwardly directed projections of the stator to define first and second sets of chambers on each side of the vanes. Front and rear side walls are provided for the phaser that close the sides of the chambers. An outer cover is attached to the stator and is connected to the inner camshaft by a drive adapter that extends through a center opening in the rotor. Radial loads acting on the timing gear are transmitted radially from the stator to the rotor and into the outer camshaft.

Preferably, the drive adapter has a hollow cylindrical body with first and second ends. The first end includes a slot or recess, and the second end has a portion configured to matingly engage a corresponding portion of the inner camshaft. A fastener can extend through the hollow body.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
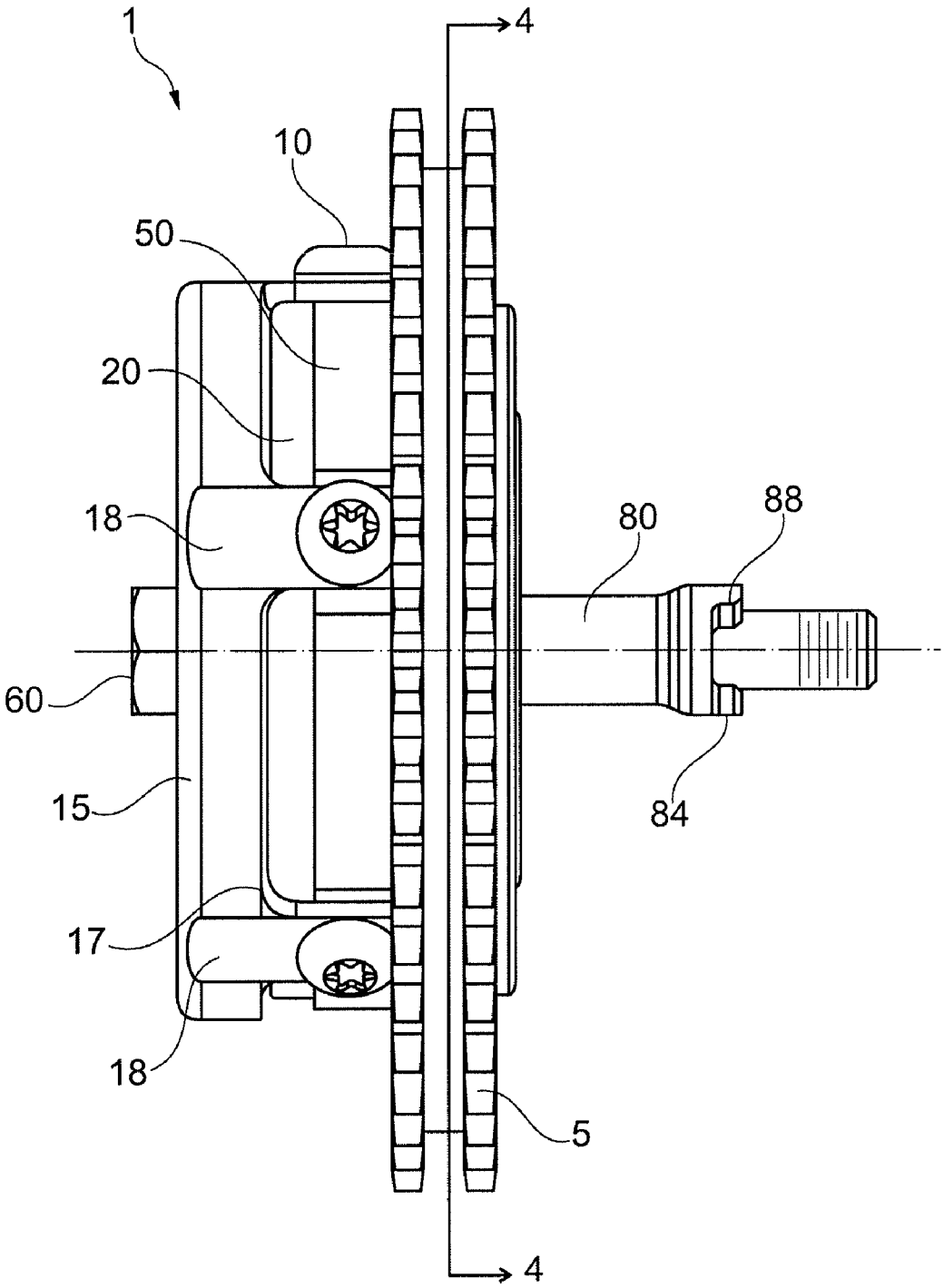
FIG. 1 is a side view of the camshaft adjuster of the present invention.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b or c" (where a, b and c represent the items being listed) means any single one of the items a, b or c, or combinations thereof. The terminology includes the words specifically noted above, derivatives thereof and words of similar import.

Referring now to FIG. 1, the outside of a camshaft adjuster 1 is shown in which a cover 15 attached by bolts 10 to a stator 50 are visible. The bolts 10 extend and attach radially into the stator 50. The cover 15 includes cut-away portions 17 that are defined between fastening portions 18 of the cover 15. In addition to reduced weight and materials used, the cut-away portions 17 allow for visual inspection of the adjuster.

Figure 2:
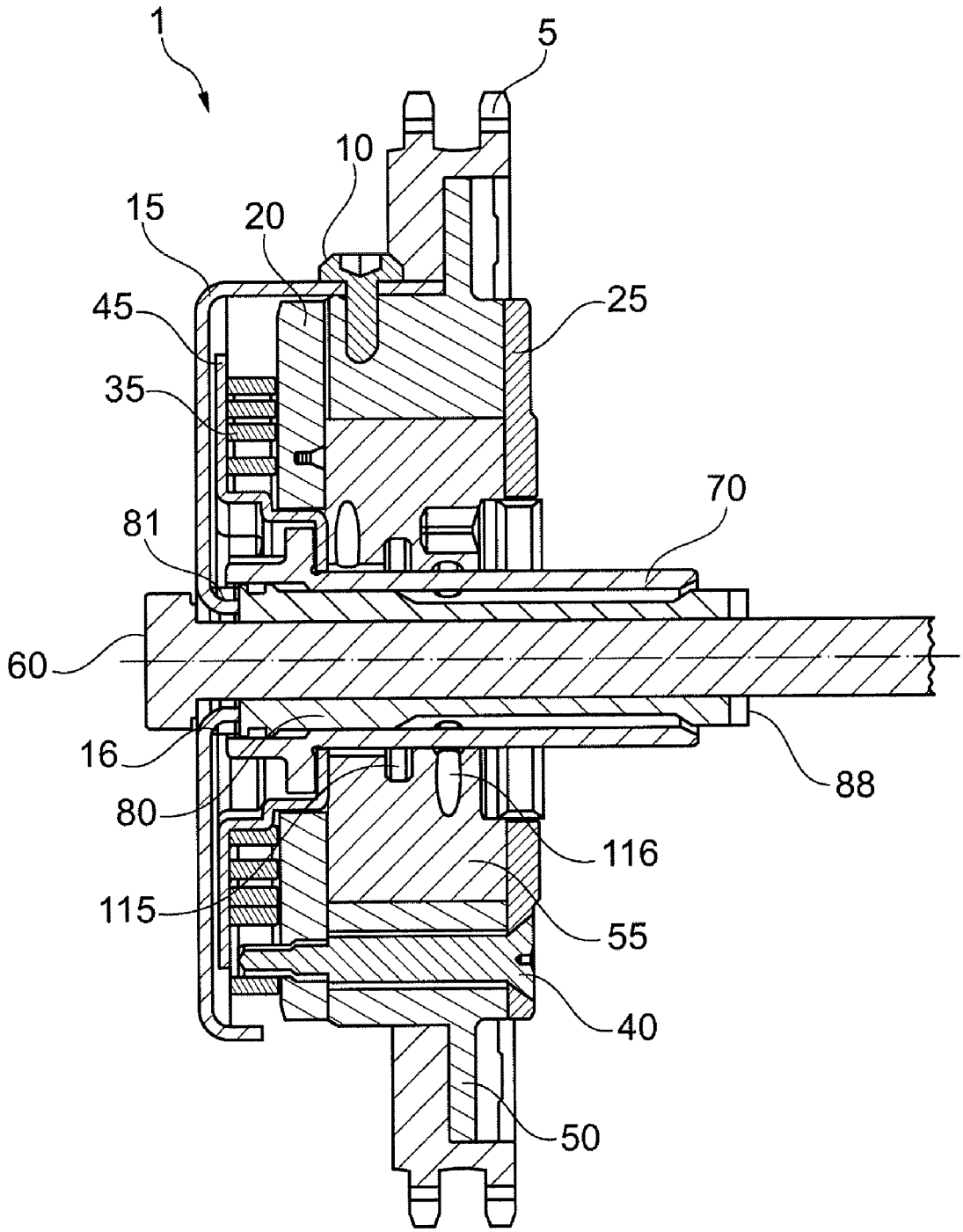
FIG. 2 is a section view through the camshaft adjuster of FIG. 1.

FIG. 2 shows the adjuster 1, having front and rear sidewalls 20, 25 and a stator 50 located between them. The stator 50 includes inwardly directed projections 52 that define recesses 100 therebetween. A rotor 55 is disposed between the sidewalls and inside the stator 50. The rotor 55 includes preferably five radially outwardly extending vanes 95 that extend into the recesses 100 in the stator to define first and second sets of pressure chambers 105, 110. The first and second sets of pressure chambers 105, 110 are pressurized with a hydraulic fluid provided by first and second pressure medium passages 115, 116. By pressurizing the first pressure chambers 105 or the second pressure chambers 110, the rotor 55 is rotated by the pressurized fluid acting on the vanes 95 to either advance or retard a position of the rotor 55, and hence the outer camshaft 86 connected thereto, relative to the stator 50 and the inner camshaft 85 and crankshaft. By pressurizing both sets of chambers 105, 110, the rotor 55 is hydraulically locked in a generally fixed position relative to the stator 50.

Pressurized hydraulic fluid is provided to the passages 115, 116 in a known manner via oil passages in or between the inner and outer camshafts 85, 86, which are fed by oil passages in a camshaft bearing journal support. An ECU (engine control unit) controlled flow valve (not shown) is used to control the flow of pressurized hydraulic fluid to one or both of the first and second sets of chambers 105, 110 via the passages 115, 116.

Figure 3:
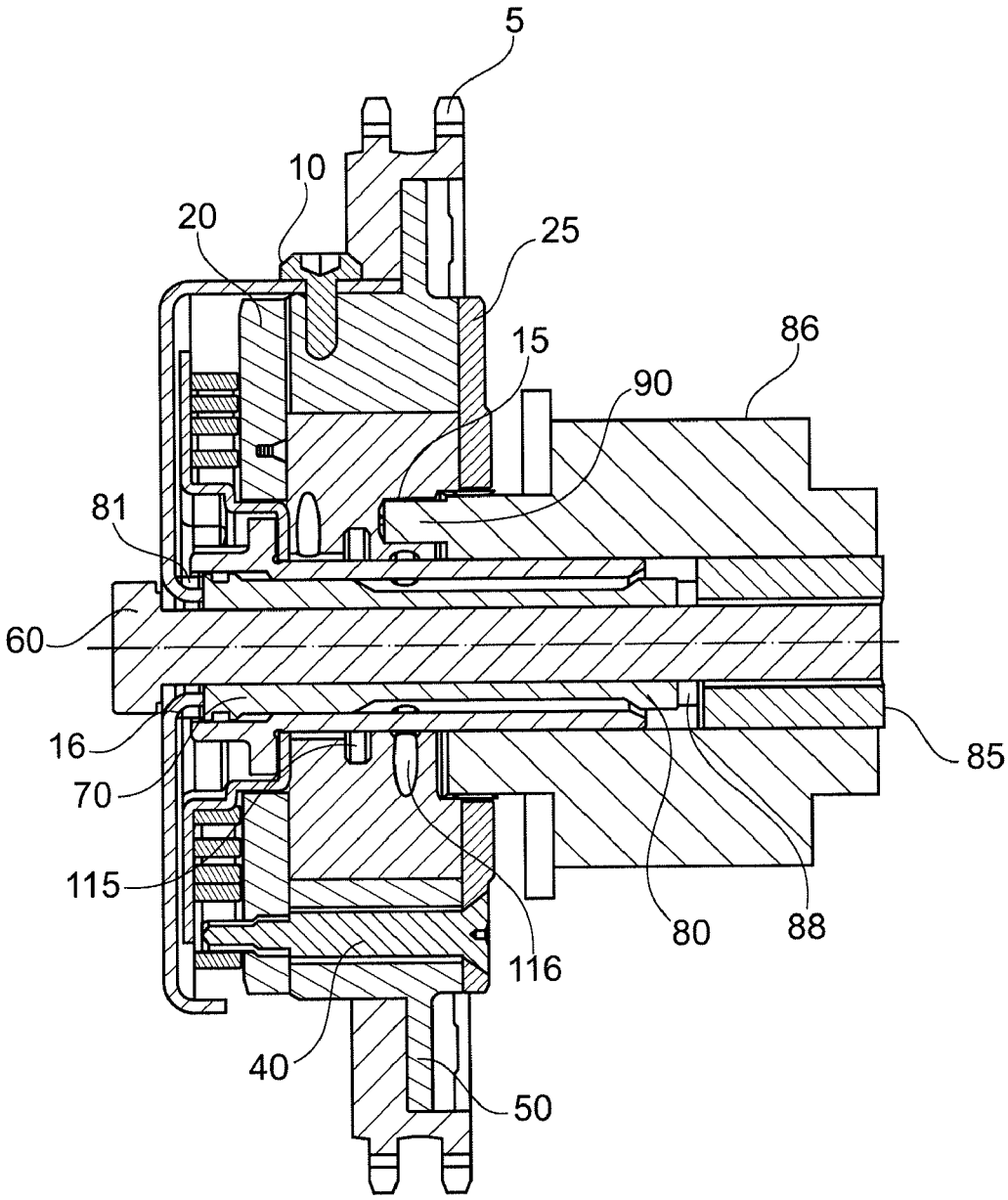
FIG. 3 shows the adjuster in FIG. 2 attached to a camshaft, shown schematically.

The inwardly directed projections of the stator 50 slidingly engage the radial outer surface of the rotor 55, allowing loads to be radially transferred from the stator 50 to the rotor 55. As shown in FIG. 3, preferably the front end of the outer camshaft 86 extends to a position that is generally axially aligned with the timing gear 5.

Figure 4:
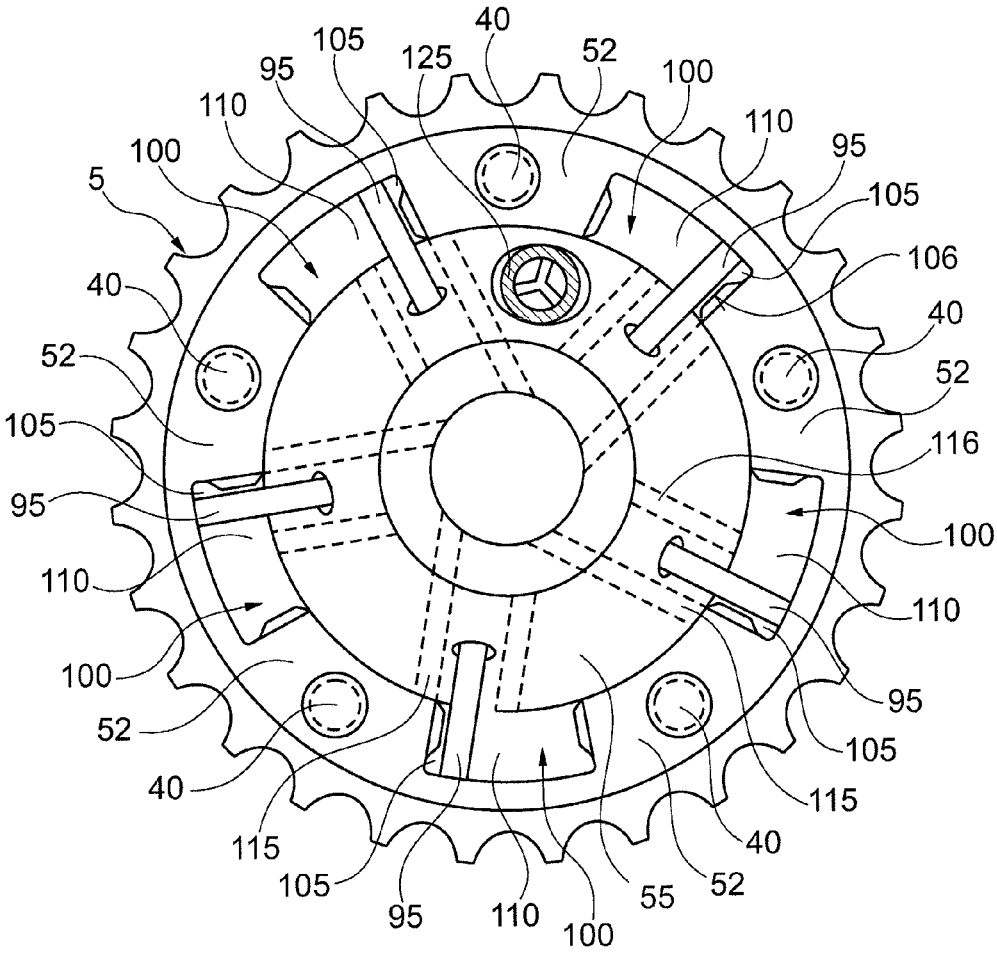
FIG. 4 is a section view taken along line 4-4 in FIG. 1.
Figure 5:
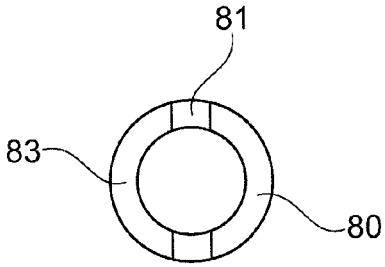
FIG. 5 is a front view of the drive adapter.
Figure 6:
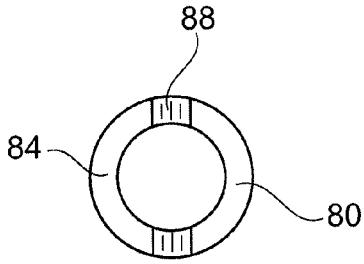
FIG. 6 is a rear view of the draft adapter.

As shown in FIG. 4, a locking pin 125 is preferably located in the rotor 55 and is used to fix the position of the rotor 55 relative to the stator 50 when the pressure chambers 105, 110 are not pressurized, such as at engine startup. The first and second sidewalls 20, 25 are joined by fasteners or screws 40 to the stator 50.

The adjuster 1 also includes a tension equalization spring 35 which is preferably a helical spring. The spring 35 is connected to the rotor 55 by helical spring cover 45 which extends through a clearance opening in the front sidewall 20 and is pressed against the rotor 55 by the hollow bolt 70, and is also connected to the stator 50 via two of the five fasteners 40 that extend through the front sidewall 20 to engage the spring 35. The spring 35 equalizes the force required to advance the rotor 55 relative to the stator 50 in comparison to the force required to retard the position of the rotor 55 relative to the stator 50.

The timing gear 5 is preferably attached to or formed on the stator 50. Alternatively, it can be formed on or attached to the front or rear sidewalls 20, 25.

The main body 2 of the phaser 1, including the stator 50, rotor 55 with vanes 95 and locking pin 125 (if present), front and rear sidewalls 20, 25 along with the timing gear 5, and the spring 35 and cover 45, is preassembled as a unit to allow for higher quality and ease of installation.

At installation, prior to the cover 15 being installed, the main body 2 is placed on the end of the inner and outer camshafts 85, 86, with the timing pin 90 of the outer camshaft 86 engaging in a timing pin bore 75 of the rotor 55. A hollow bolt 70 is then installed and clamps the rotor 55 to the outer camshaft 86.

A drive adapter 80 is preferably used to connect the stator 50 to the inner camshaft 85. The drive adapter 80 includes an open cylindrical body 82, having first and second ends 83, 84, and a length sufficient to extend axially through the main body 2. The first end 83 includes a slot or recess in which the locating tabs 16 of the cover engage 82. The second end 84 has a keyed portion 88 for positive engagement in the front end of the inner camshaft 85. The slot 81 at the front end of the drive adapter 80 receive the locating tabs 16 of the cover 15, which in conjunction with the keyed portion 88 at the second end 84, to define and maintain the proper timing location of the inner camshaft 85 relative to the crankshaft via the stator 50 and cover 15.

The cover 15, which includes an opening for a central fastener 60 and locating tabs 16 on each side of the opening, is then installed. The locating tabs 16 of the cover 15 are received in the slot 81 at the front of the drive adaptor 80 to define and maintain the proper timing location of the inner camshaft 85 relative to the crankshaft via the stator 50 and cover 15. The central fastener 60 is inserted through a central bore of a drive adapter 80 and engages in a threaded opening in the front of the inner camshaft 85, clamping the cover 15 to the drive adapter 80 and the inner camshaft 85. The bolts 10 are then installed to attach the cover 15 to the stator 50.

Preferably, the cover 15 is a deep drawn sheet metal part but can also be cast, milled, laser cut, etc. The cover 15 transfers the rotary movement of the stator 50 to the inner camshaft 86.

Owing to its unique design, the main body 2 of the camshaft phaser 1 of the present invention can be installed as a pre-assembled unit, thus no seals are required to be handled at installation for sealing the inner and outer chambers as in the known conventional design. Furthermore, no contamination of the internal phaser can occur when the phaser is installed. The main body 2 of phaser 1, including the stator 50, rotor 55 and the front and rear covers 25, 20 is also removable and replaceable as a single unit with greatly reduced labor.

Since timing chains or belts generally have limited slack to maximize efficiency, a camshaft adjuster cannot normally pass onto or off of an inner nose of a camshaft while the chain or belt is attached to the phaser sprocket and the crankshaft sprocket. By using, the drive adapter 80 of the present invention, the phaser 1 can be attached to or detached from the inner crankshaft 85 while the drive chain is attached to the timing gear 5 and the crankshaft sprocket (not shown). This is because the drive adapter 80 and bolt 60 can be slid into or out from the hollow bolt 70 to engage or disengage from the inner camshaft 85, which, as shown in FIG. 3, does not axially overlap with the camshaft adjuster 1 in the installed position.

Removal is also facilitated by use of the drive adapter 80, which eliminates the need for a large clearance at the front of the phaser 1 in the engine compartment to slide the phaser off the front of an extended inner camshaft.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A camshaft adjuster for a concentric camshaft assembly having inner and outer shafts for an internal combustion engine, the camshaft adjuster comprises:

a stator connected to a timing gear;

a rotor located within the stator and adapted to be connected to the outer camshaft, the rotor including a plurality of vanes that extend into spaces created between inwardly directed projections of the stator which contact the rotor to define first and second sets of chambers on each side of the vanes;

front and rear sidewalls connected to the stator which form the front and rear walls of the chambers;

a drive adapter which extends through the rotor from a front of the camshaft adjuster to a position beyond the rear sidewall of the camshaft adjuster and is adapted to engage the inner camshaft;

an outer cover connected between the stator and the drive adapter, wherein radial loads acting on the timing gear are transmitted radially from the stator to the rotor and into the outer camshaft.

2. The camshaft adjuster of claim 1, wherein the drive adapter includes a slot or recesses in a front end thereof and the outer cover further comprises locating tabs that engage in the slot or recesses for setting a timing position of the stator relative to the inner camshaft.

3. The camshaft adjuster of claim 1, wherein the drive adapter includes a keyed end on a rearward facing portion thereof which is adapted to engage a complementary portion on a front end of the inner camshaft.

4. The camshaft adjuster assembly of claim 1, wherein the rotor, the stator, and the front and rear sidewalls are assembled as a single unit attachment to both the inner and outer camshafts.

* * * * *